US006550355B1

(12) United States Patent
Chiang

(10) Patent No.: US 6,550,355 B1
(45) Date of Patent: Apr. 22, 2003

(54) BICYCLE CRANKSHAFT ASSEMBLY

(76) Inventor: Douglas Chiang, 487, Ko-Chung Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/567,763

(22) Filed: May 9, 2000

(51) Int. Cl.[7] ..... G05G 1/14
(52) U.S. Cl. ..... 74/594.1; 384/545
(58) Field of Search ..... 74/594.1; 384/545

(56) References Cited

U.S. PATENT DOCUMENTS 5,437,510 A 8/1995 Jeng ..... 384/538
5,473,962 A * 12/1995 Yamamoto ..... 74/594.1
5,572,909 A * 11/1996 Chi ..... 74/594.1
5,634,727 A * 6/1997 Lin et al. ..... 384/545
6,024,662 A * 2/2000 Fujimoto ..... 474/144

* cited by examiner

*Primary Examiner*—David A. Bucci
*Assistant Examiner*—Vicky A. Johnson
(74) *Attorney, Agent, or Firm*—Rosenberg, Klein & Lee

(57) ABSTRACT

A bicycle crankshaft assembly in accordance with the present invention comprises a frame tube having first and second end portions and defining a passage extending between the end portions. The first end portion define a first opening, and the second end portion define a second opening different to the first opening. An axle is securely assembled into the passage from the second end portion and the axle includes a bushing with a crankshaft rotationally supported therein. The crankshaft includes first and second coupling portions extending over the first and second openings of the first and second end portions of the frame tube. Wherein the first opening is dimensioned such that a first end of the bushing is limited from extending therethrough.

3 Claims, 4 Drawing Sheets

BICYCLE CRANKSHAFT ASSEMBLY

FIELD OF THE INVENTION

The present invention relates to a crankshaft, and more particularly to a bicycle crankshaft assembly in which a crankshaft is properly supported by a shockproof ring within a frame tube.

DESCRIPTION OF THE PRIOR ART

As shown in FIG. 1, a bicycle crank axle set 1A of the prior art comprises an axle 2A, a sleeve 3A fastened with one end of the axle 2A, and a threaded casing 4A fastened with the other end of the axle 2A. The crank axle set 1A is fastened with a bicycle frame tube 5A which is provided in one end with inner threads 6A, and in other end with inner threads 7A. The threaded casing 4A is made by punching and therefore is not cost-effective. The bicycle frame tube 5A is provided in both ends thereof with inner threads 6A and 7A, which are also not cost-effective. In addition to the high production cost of the crank axle set 1A and the frame tube 5A, the fastening of the crank axle set 1A with the frame tube 5A is not reliable in view of the fact that the fastening mechanism is attained by the threads, which are susceptible to wear or damage. As a result, the axle 2A of the bicycle axle set 1A is apt to become loose.

SUMMARY OF THE INVENTION

It is an objective of this invention to provide a bicycle crankshaft assembly configured by simple but reliable structure.

In order to achieve the objective set forth, a bicycle crankshaft assembly in accordance with the present invention comprises a frame tube having first and second end portions and defining a passage extending between the end portions. The first end portion define a first opening, and the second end portion define a second opening different to the first opening. An axle is securely assembled into the passage from the second end portion and the axle includes a bushing with a crankshaft rotationally supported therein. The crankshaft includes first and second coupling portions extending over the first and second openings of the first and second end portions of the frame tube. Wherein the first opening is dimensioned such that a first end of the bushing is limited from extending therethrough.

The features of the present invention will be more readily understood upon a thoughtful deliberation of the following detailed description of a preferred embodiment of the present invention with reference to the accompanying drawings.

DETAILED DESCRIPTION OF PREFERRED EMBODIMENT

Figure 1:
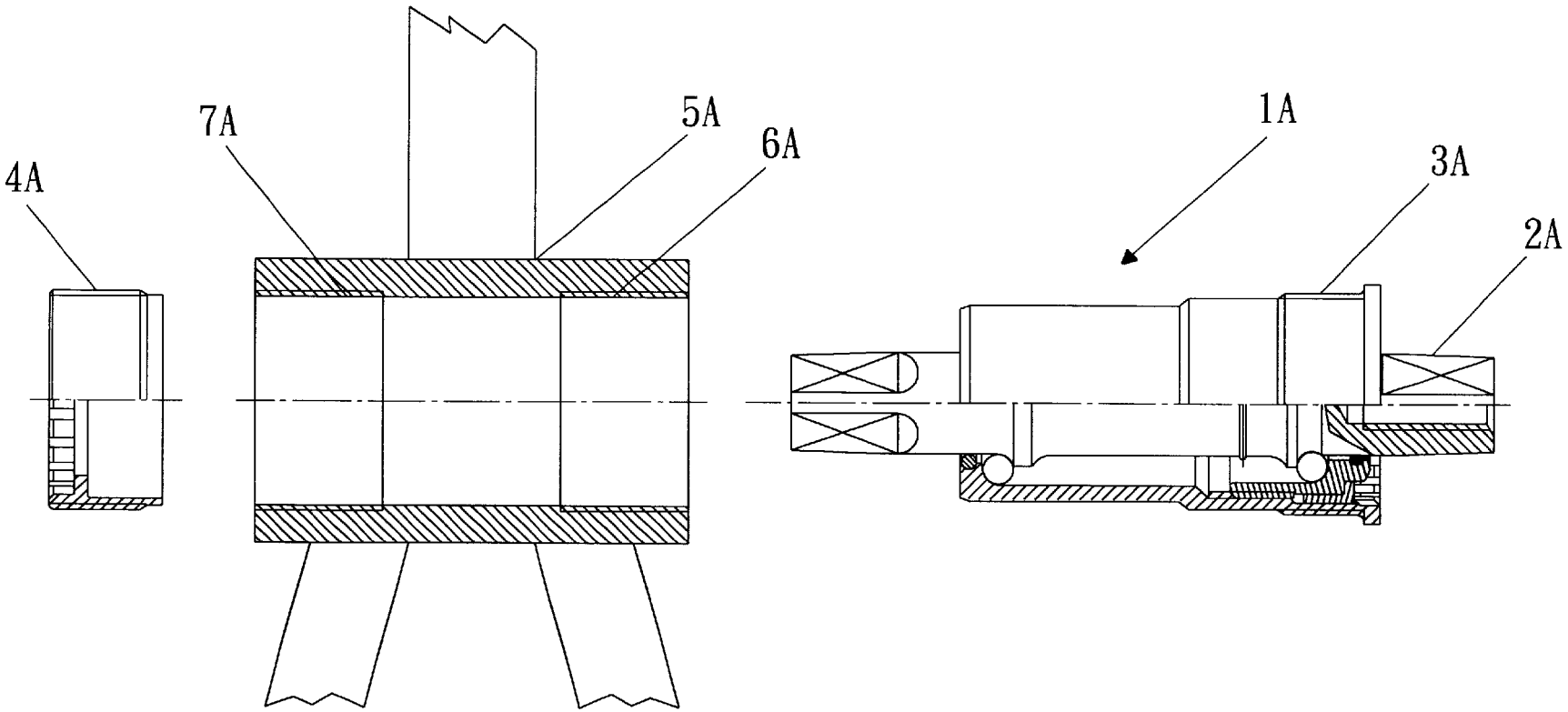
Fig. 1 Prior Art
FIG. 1 is a sectional schematic view of a bicycle crank axle assembly of the prior art.
Figure 2:
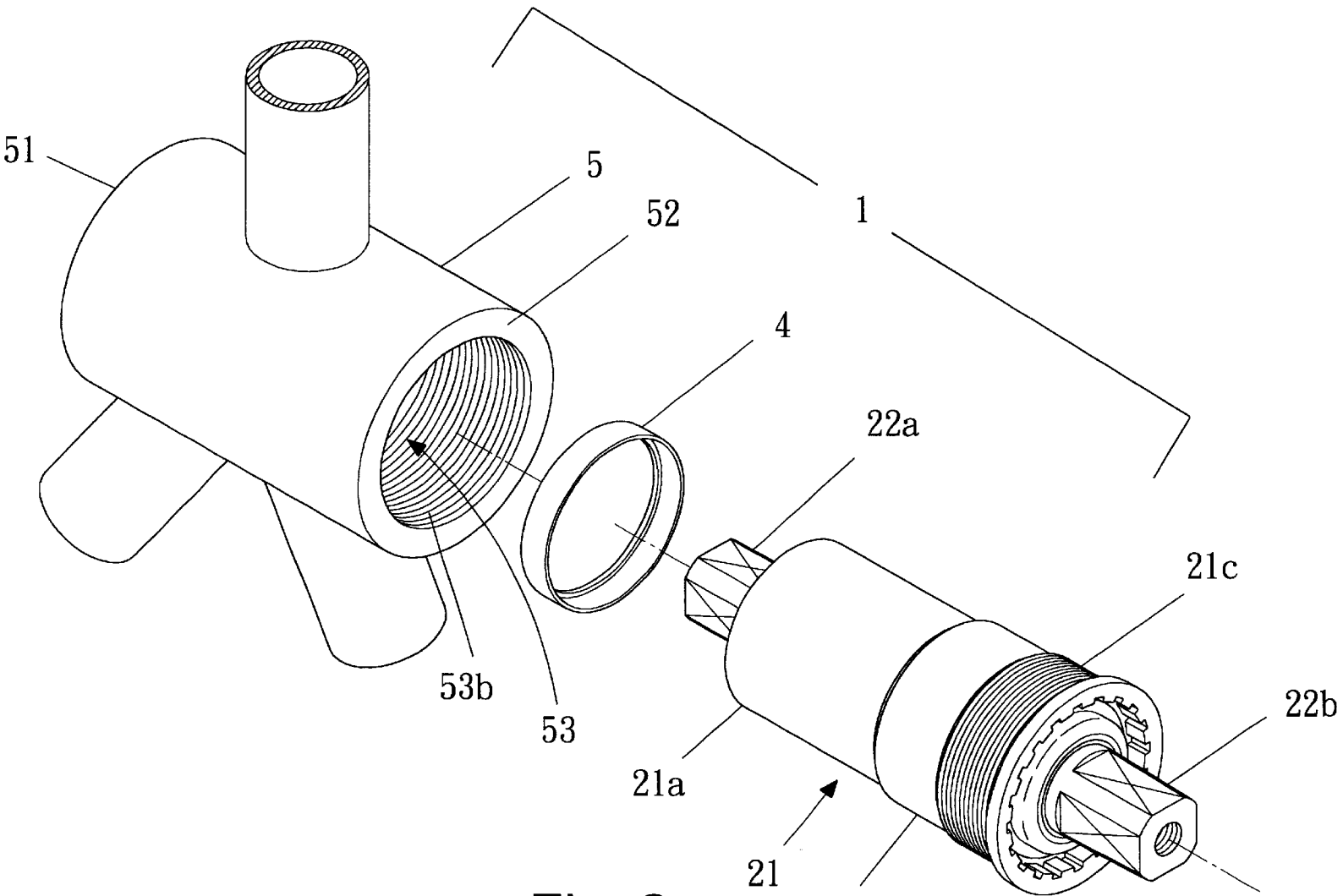
FIG. 2 is an exploded view of a bicycle crankshaft assembly in accordance with a preferred embodiment of the present invention.
Figure 3:
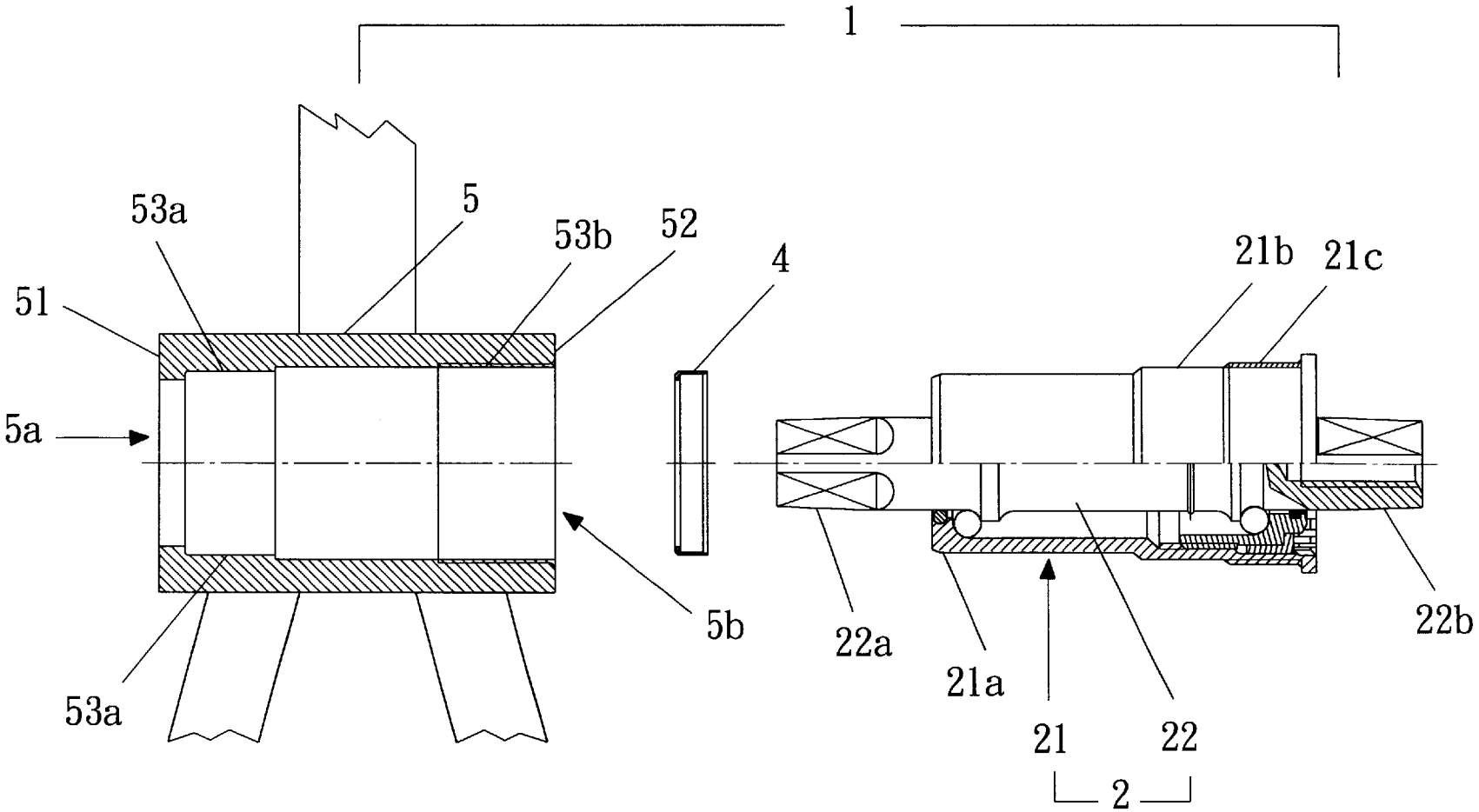
FIG. 3 is a sectional schematic view of FIG. 2.
Figure 4:
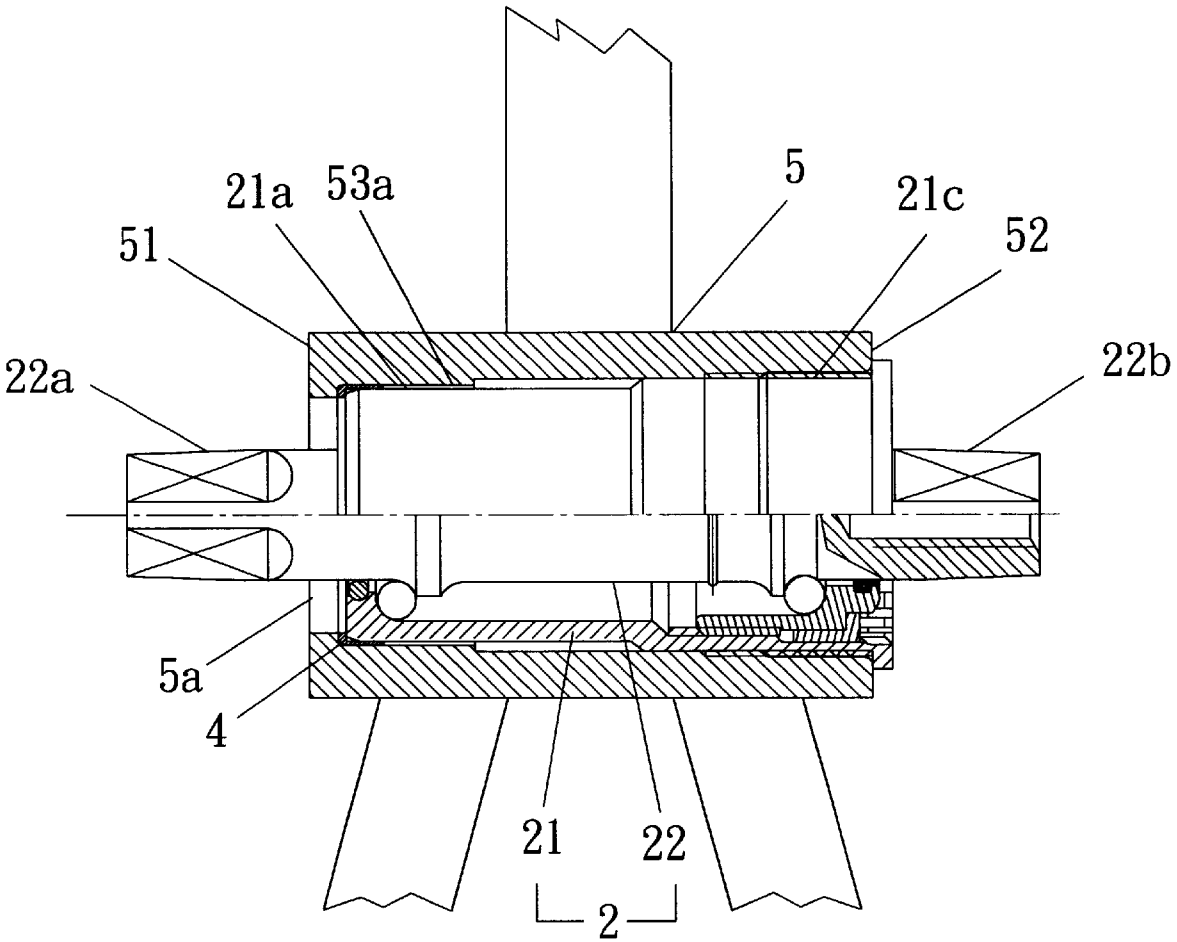
FIG. 4 is an assembled sectional view of the bicycle crankshaft assembly.

Referring to FIGS. 2 and 3, the frame tube 5 of the bicycle crankshaft assembly 1 of the present invention defines first and second end portions 51, 52 and a passage 53 extending between said end portions 51, 52. The first end portion 51 defines a first opening 5*a*, and said second end portion 52 defines a second opening 5*b* having different inner diameter to said first opening 5*a*. The passage 53 further defines a shoulder portion 53*a* adjacent to the first opening 5*a*, and forms an inner threaded portion 53*b* adjacent to the second end portion 52.

An axle 2 is securely assembled into said passage 53 through the second opening 5*b* of in the second end portion 52 of the frame tube 5. The axle 2 includes a bushing 21 with a crankshaft 22 rotationally supported therein. The crankshaft 22 includes first and second coupling portions 22*a*, 22*b* extending over said first and second openings 5*a*, 5*b* of said first and second end portions 51, 52 of said frame tube 5.

The bushing 21 is configured with a first section 21*a* and a second section 21*b* having a dimension larger than the first section 21*a*. The second section 21*b* is formed with outer threaded portion 21*c* corresponding to the inner threaded portion 53*b* of the passage 53. By this arrangement, the bushing 21 can securely assembled to the frame tube 5.

In order to smoothly assemble the axle 2 into the passage 53 of the frame tube 5, the dimensions of the shoulder portion 53*a* and the first section 21*a* of the bushing 2 have been carefully arranged such that the shoulder portion 53*a* is larger than the first section 21*a*. By this arrangement, the axle 2 can be easily and smoothly assembled into the passage 53 of the frame tube 5.

However, because the axle 2 has to sustain a great deal of forces, it has to be securely supported within the passage 53. Accordingly, a shockproof ring 4 is arranged between the first section 21*a* and the shoulder portion 53*a* so as to compensate any gap therebetween. The shockproof ring 4 can be accurately machined such that it is right fitted therebetween.

In assembly, the shockproof ring 4 is firstly assembled to an end of the first section 21*a* of the bushing 2. Then the axle 2 extends into the passage 53 from the second opening 5*b* such that the shockproof ring 4 abuts against to the shoulder portion 53*a*. With the threaded inward movement between the inner threaded portion 53*b* and the outer threaded portion 21*c*, the shockproof ring 4 moves into the shoulder portion 53*a* till it finally abuts against the first opening 5*a*. Finally, the axle 2 is securely seated within the passage 53 with the coupling ends 22*a*, 22*b* of the crankshaft 22 extending beyond the first and second openings 5*a*, 5*b* of the frame tube 5.

By the suggestion of the instant invention, the threaded casing 4A has been removed thereby largely reducing the manufacturing cost.

It will be understood that the invention may be embodied in other specific forms without departing from the spirit or central characteristics thereof. The present example and embodiment, therefore, is to be considered in all respects as illustrative and not restrictive, and the invention is not to be limited to the details given herein.

I claim:

1. A bicycle crankshaft assembly, comprising a frame tube having first and second end portions and defining a passage extending between said end portions;

said first end portion defining a first opening, and said second end portion defining a second opening, said second opening having a different dimension than said first opening, said passage including a shoulder portion adjacent to said first opening;

an axle securely assembled into said passage from said second end portion thereof, said axle including a bushing with a crankshaft rotationally supported therein, said crankshaft including first and second coupling portions extending over said first and second openings of said first and second end portions of said frame body; and a shockproof ring arranged between said bushing and passage in said shoulder portion for supporting said bushing within said passage;

wherein said first opening is dimensioned such that a first end of said bushing is limited from extending therethrough.

2. The frame tube as recited in claim 1, wherein a second end of said bushing includes an outer threaded portion securely engage with an inner threaded portion in said passage adjacent to said second end portion.

3. A bicycle crankshaft assembly, comprising a frame tube having first and second end portions and defining a passage extending between said end portions;

said first end portion defining a first opening, and said second end portion defining a second opening different to said first opening;

an axle securely assembled into said passage from said second end portion, said axle including a bushing with a crankshaft rotationally supported therein, said crankshaft including first and second coupling portions extending over said first and second openings of said first and second end portions of said frame body; and a shockproof ring arranged between a first section of the bushing and a shoulder in said passage so as to properly support the bushing within the passage.

* * * * *